US007090591B2

(12) United States Patent
Sano

(10) Patent No.: US 7,090,591 B2
(45) Date of Patent: Aug. 15, 2006

(54) GOLF CLUB HEAD

(75) Inventor: Yoshinori Sano, Kobe (JP)

(73) Assignee: SRI Sports Limited, Kobe (JP)

( * ) Notice: Subject to any disclaimer, the term of this patent is extended or adjusted under 35 U.S.C. 154(b) by 26 days.

(21) Appl. No.: 10/745,643

(22) Filed: Dec. 29, 2003

(65) Prior Publication Data

US 2004/0142764 A1 Jul. 22, 2004

(30) Foreign Application Priority Data

Jan. 22, 2003 (JP) ..... 2003-013219

(51) Int. Cl.
*A63B 53/04* (2006.01)

(52) U.S. Cl. ..... 473/324; 473/349

(58) Field of Classification Search ..... 473/349, 473/324, 131, 346, 347, 348, 350, 290, 291, 473/330, 331, 342

See application file for complete search history.

(56) References Cited

U.S. PATENT DOCUMENTS 6,450,900 B1 * 9/2002 Kametani et al. ..... 473/377
2002/0183133 A1 * 12/2002 Sano ..... 473/324

OTHER PUBLICATIONS

2003 Nippon Sheet Glass Annual Report, 2003, downloaded from the internet Apr. 19, 2005,http://www.nsg.co.jp/en/ir/annual/2003/2003.pdf, pp. 1,12,13.*

Web Page downloaded Aug. 8, 2005, NFG-Canada, Jan. 27, 2001, www.nfgcanada.com/special.htm, 3 pages.*

* cited by examiner

*Primary Examiner*—Eugene Kim
*Assistant Examiner*—M. Chambers
(74) *Attorney, Agent, or Firm*—Birch, Stewart, Kolasch & Birch, LLP

(57) ABSTRACT

A golf club head comprising a head substrate having a coating film formed on a surface thereof. The coating film contains a shiny layer made of a shiny coating material containing metal oxide-coated glass pieces, with the content of the glass pieces in the shiny coating material being in a range of 0.01 wt % to 1.0 wt % relative to the solid component of the shiny coating material. Furthermore, the coating film has a total thickness of not more than 100 μm.

8 Claims, 2 Drawing Sheets

GOLF CLUB HEAD

BACKGROUND OF THE INVENTION

This Non-provisional application claims priority under 35 U.S.C. § 119(a) on patent application Ser. No. 2003-013219 filed in Japan on Jan. 22, 2003, the entire contents of which are hereby incorporated by reference.

1. Field of the Invention

The present invention relates to a golf club head having a shiny coating film.

2. Description of the Related Art

Conventionally, golf club heads such as metal heads are often coated to improve their appearance, and in general a color coating material containing a color pigment or a metallic coating material is used. Moreover, to further improve the appearance, for example a polarizing coating material containing a polarizing material, and a color clear coating material through which can be seen the metal surface of a metal head substrate have been used (see, for example, Japanese Patent Application Laid-open No. 2002-325868).

With coating using a color coating material or metallic coating material, there are no problems with the ease of coating or the durability. However, regarding the external appearance of coated heads, there is a problem that there may not be an impression of the coating film being thick, or there may be a heavy feeling and hence there may not be a luxurious impression, and hence such coated heads are not favored by mid level and top level golf players in particular. To eliminate this problem, coating is carried out using a polarizing coating material containing a pearl pigment or the like, but it has not been possible to sufficiently achieve an external appearance giving an impression that the coating is thick.

Moreover, with color clear coating in which the metal surface of the head substrate can be seen through the coating, reflected light from the metal surface can be seen, and hence an impression of the coating being thick can be attained, and moreover the appearance is very attractive due to their being a metallic luster. However, to bring out the metallic luster, it is necessary to polish the surface of the head substrate to a mirror finish or a satin finish, and hence the roughness of the surface is reduced, and as a result adhesion of the coating film to the surface becomes poor. Furthermore, cavities are prone to occurring in the surface of a metal head manufactured by casting in particular, and with color clear coating, these cavities can be seen, and hence there has been a problem that it has been necessary to go to the trouble of carrying out surface preparation to conceal the cavities.

In view of the problems described above, it is an object of the present invention to provide a golf club head according to which a coating film that has a suitable degree of shininess and gives an impression of thickness can be formed, and hence the golf club head has an excellent external appearance with a luxurious impression, and moreover the adhesion of the coating film is excellent.

SUMMARY OF THE INVENTION

The present invention provides a golf club head having a coating film formed on a surface of a head substrate, wherein the coating film contains a shiny layer made of a shiny coating material containing metal oxide-coated glass pieces, the content of the glass pieces in the shiny coating material is in a range of 0.01 wt % to 1.0 wt % relative to the solid component of the shiny coating material, and the coating film has a total thickness of not more than 100 μm.

According to this constitution, because the metal oxide-coated glass pieces are optically transparent, light passes through the glass pieces and reaches lower layers below the shiny layer, and moreover light from these lower layers passes through the glass pieces and can be seen. The amount of reflected light from the foundation below the shiny layer is thus increased, and hence an impression of the coating film being thick can be achieved. Furthermore, light reflected at the surface of the metal oxide coating layer and light reflected at the glass surface of the glass substrate below this coating layer undergoes interference, and hence any of various colors is produced in accordance with the thickness of the coating layer. Unique coloring and shininess are thus obtained through this colored light and other reflected light. Shininess can thus be obtained even if the head substrate is not processed to give a luster. Furthermore, because the percentage content of the glass pieces is limited to being in the above-mentioned range, a suitable degree of shininess and coating film strength can be obtained. Moreover, because the total thickness of the coating film is made to be not more than 100 μm, good impact resistance of the coating film can be secured.

The coating film may be made to have a constitution containing a colored layer that is made of a color coating material containing a color pigment; a polarizing layer that is formed on the outside of the colored layer and is made of a polarizing coating material containing a polarizing pigment; and the shiny layer which is formed on the outside of the polarizing layer.

According to this constitution, in addition to the effects due to the shiny layer described above, the reflected light from the colored layer and the various types of light from the shiny layer are each subjected to a polarization effect by the polarizing layer, and hence through this plurality of polarization effects, reflected light having a variety of polarization and high shininess can be obtained.

Moreover, a constitution may be adopted in which a clear layer that is made of a clear coating material is provided on the outside of the shiny layer, wherein this clear layer is the outermost layer of the coating film. In this case, light from the shiny layer can be seen sufficiently, and the shiny layer can be protected without blacking out the shiny layer.

The above-mentioned shiny coating material may be constituted from a clear coating material having the glass pieces contained therein. According to this constitution, the optical transparency of the shiny layer is further increased, and hence the effects of the shiny layer described above can be made yet more prominent.

Moreover, the glass pieces preferably have a mean thickness in a range of 0.1 μm to 10 μm, and a mean particle diameter in a range of 5 μm to 250 μm. According to this constitution, because the thickness range is limited, both shininess and impact resistance can be achieved. Moreover, because the mean particle diameter range is limited, there is no lack of shininess due to the particle diameter being too small, and moreover marring of the external appearance due to asperity arising on the surface of the coating film due to the particle diameter being too large is suppressed.

DETAILED DESCRIPTION OF THE PREFERRED EMBODIMENTS

Figure 1:
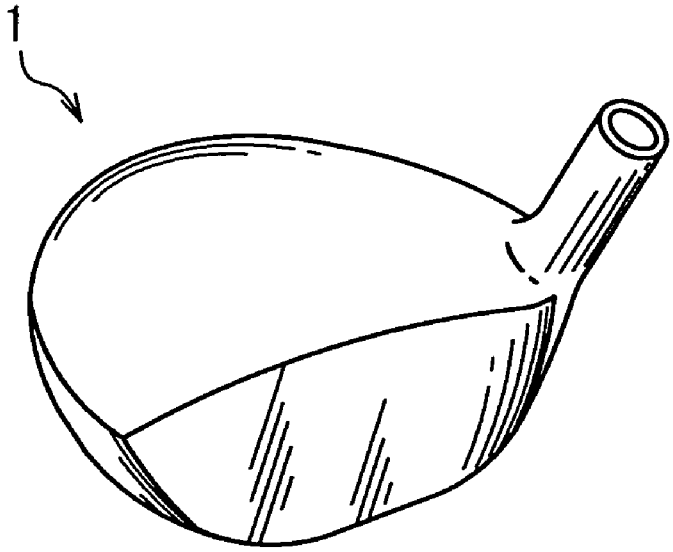
FIG. 1 is a perspective view of a golf club head according to an embodiment of the present invention.
Figure 2:
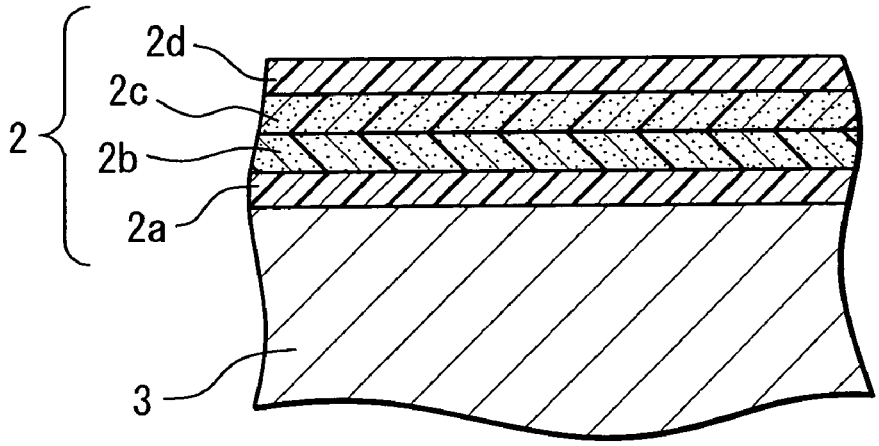
FIG. 2 is an enlarged sectional view of a coating film part of the golf club head of FIG. 1.

Following is a description of an embodiment of the present invention with reference to the drawings. FIG. 1 is a perspective view of a head 1, which is a wood-type golf club head having the whole of the outer surface thereof coated, according to an embodiment of the present invention. FIG. 2 is an enlarged sectional view of the coating film part of the head 1. The coating film 2 comprises a total of four layers, a primer layer 2*a* formed on the surface of a head substrate 3, a colored layer 2*b* formed on the primer layer 2*a*, a shiny layer 2*c* formed on the colored layer 2*b*, and a clear layer 2*d* formed on the shiny layer 2*c* as the outermost layer of the coating film 2.

The primer layer 2*a* acts to fill up asperity in the surface of the head substrate 3, thus making the foundation of the coating film smooth, and also to improve the adhesion between the head substrate 3, which is made of metal or the like, and the coating film. As the material of the primer layer 2*a*, a colorless transparent coating material is preferable, with it being possible to use a coating material having as a base resin thereof a polyester resin, a urethane resin, an epoxy resin, an acrylic resin, or the like; a polyester resin is preferably used, since adhesion to metals such as titanium alloys and stainless steel is good and impact resistance is excellent. There are no particular limitations on the thickness of the primer layer 2*a*, but this thickness is preferably made to be, for example, 5 to 40 μm, more preferably 10 to 25 μm. This is because if the primer layer 2*a* is too thin, then it may be difficult to fill up the asperity in the head surface to make the head surface smooth, whereas if the primer layer 2*a* is too thick, then the impact resistance tends to drop.

The color coating material constituting the colored layer 2*b* is a coating material containing a color pigment, and there are no particular limitations on the materials thereof; it is possible to use a coating material having a polyester resin, a urethane resin, an epoxy resin, an acrylic resin or the like as a base resin, with a color pigment for producing a desired color, a solvent and so on mixed therein. There are no particular limitations on the thickness of the colored layer 2*b*, but this thickness is preferably 1 to 25 μm, more preferably 10 to 20 μm. This is because if the colored layer 2*b* is too thick, then the impact resistance tends to drop, whereas if the colored layer 2*b* is too thin, then the desired color may not be produced.

The clear layer 2*d* is a transparent layer, and acts to protect the shiny layer 2*c* and thus improve the durability of the coating film. Reflected light from the shiny layer 2*c* and so on is transmitted by the clear layer 2*d*, and hence the effects of the present invention can be brought out sufficiently. There are no particular limitations on the clear coating material constituting the clear layer 2*d*, but for example a coating material having as a base resin thereof a polyester resin, a urethane resin, an epoxy resin, an acrylic resin, or the like can be used.

The shiny layer 2*c* is made of a shiny coating material containing metal oxide-coated glass pieces. The glass pieces are made of a transparent glass such as C glass or E glass that is able to transmit light, and moreover a characteristic feature is that the metal oxide coating layer coating the glass pieces also transmits light. With the metal oxide-coated glass pieces, interference occurs between reflected light that has been reflected at the surface of the coating layer and reflected light that has passed through the coating layer and been reflected at the surface of the glass substrate, and hence an interference color is produced in accordance with the thickness of the coating layer. Moreover, coloring also occurs for light that passes through the coating layer and the glass substrate, and this coloring may be of a different color to the interference color. Furthermore, transmitted light that reaches the colored layer 2*b* becomes reflected light from the colored layer 2*b* and reaches the shiny layer 2*c*, and out of this light, some of the light that strikes the metal oxide-coated glass pieces passes through the glass pieces, and then passes through the clear layer 2*d* and is seen. Moreover, light that reaches the colored layer 2*b* from the outside without passing through a glass piece also becomes reflected light from the colored layer 2*b*, and some of this reflected light passes through a glass piece, exits and is seen, and moreover there is of course also light that passes through the shiny layer 2*c* without striking a glass piece, exits and is seen.

In this way, regarding the metal oxide-coated glass pieces present in the shiny layer 2*c*, the glass substrate itself has high optical transparency, and moreover the metal oxide layer that is the coating layer also has relatively high optical transparency, and hence based on this optical transparency, a complex variety of light can be realized. Moreover, with a conventional polarizing coating material, a polarizing material such as aluminum flakes or mica has been used, and hence the polarizing material has no or very low optical transparency. Light from lower layers is thus blocked, and hence the amount of reflected light from the foundation is reduced, and thus it has not been possible to produce an external appearance giving an impression that the coating is thick. With the present invention, the coating layer and the glass substrate of the glass pieces both have relatively high optical transparency, and hence the proportion of the light from the lower layers that is blocked is low. The amount of reflected light from the foundation can thus be made to be high, and hence it is possible to produce an external appearance giving an impression that the coating is thick. Furthermore, due to a complex variety of reflected light being realized as described above, an impression that the coating is thick can be achieved, and moreover there is richness and a luxurious impression, and hence a highly decorative external appearance can be produced. Moreover, by carrying out the coating using a technique such as spraying, the glass pieces can be made to be randomly orientated in the coating film, and a shiny appearance can be obtained over a broad range.

The content of the glass pieces in the shiny coating material constituting the shiny layer 2*c* is made to be in a range of 0.01 wt % to 1.0 wt %, more preferably 0.05 wt % to 0.5 wt %, relative to the solid component (vehicle component) of the shiny coating material. If this content is too high, then the shininess will become excessively high, resulting in a dazzling external appearance, and hence it will no longer be possible to attain an external appearance with a luxurious impression, and moreover the proportion of the resin component in the coating film will drop, and hence the strength of the coating film will drop. Moreover, if the content of the glass pieces is too low, then the effects of the present invention such as shininess will be reduced.

There are no particular limitations on the matrix coating material (the coating material component other than the glass pieces) in the shiny coating material constituting the shiny layer 2*c*, with it being possible to use a coating material having as a base resin thereof a polyester resin, a urethane resin, an epoxy resin, an acrylic resin, or the like as mentioned earlier. This coating material is preferably made to be the same as the clear coating material described earlier. As a result, the shiny coating material comprises the clear coating material with the glass pieces contained therein, and hence the optical transparency of the shiny layer 2*c* is increased. The amount of reflected light from the foundation below the shiny layer 2*c* thus becomes higher, and hence an external appearance giving an impression that the coating is thick can be realized more effectively. Moreover, the amount of light entering the shiny layer 2*c* and the amount of reflected light from the shiny layer 2*c* are increased, and hence the effects due to the shiny layer 2*c* described above can be further increased.

Moreover, with the present invention, the total thickness of the coating film 2, i.e. in the case of the present embodiment the total thickness of the primer layer 2*a* plus the colored layer 2*b* plus the shiny layer 2*c* plus the clear layer 2*d*, is made to be not more than 100 μm. If this total thickness is too high, then the impact resistance of the coating film tends to become poor. This total thickness is thus more preferably not more than 90 μm. Moreover, if the total thickness is too low, then the shininess effect will be limited, and hence it is preferable to also give consideration to the lower limit of the total thickness. Here, to secure the shininess effect, and to secure good impact resistance of the shiny layer 2*c*, it is preferable to make the thickness of the shiny layer 2*c* be in a range of 10 μm to 40 μm, more preferably 15 μm to 30 μm. It is thus preferable to make the total thickness of the coating film 2 be at least this thickness of the shiny layer 2*c*.

There are no particular limitations on the sequence or combination of the layers, but with the present invention, the effect of the shiny layer 2*c* is the principal object of the invention, and hence it must be possible to see light from the shiny layer 2*c*. It is thus preferable to form the shiny layer 2*c* as the outermost layer, or else form only a clear layer 2*d* on the outside of the shiny layer 2*c*. Moreover, it is preferable to form a colored layer 2*b* below the shiny layer 2*c* as in the present embodiment, since in this case through the combination of the colored reflected light from the colored layer 2*b* and the reflected light and transmitted light from the shiny layer 2*c*, a complex variety of colors can be realized, and hence an external appearance with more richness can be attained.

The shape of the glass pieces is preferably plate-like (i.e. glass flakes). If the glass pieces have such a shape, then the glass pieces will have many smooth surfaces, and hence shininess can be obtained, and moreover a good balance between light reflected by the glass pieces and light transmitted by the glass pieces can be secured. Moreover, the thickness (mean thickness) of the glass pieces is preferably in a range of 0.1 μm to 10 μm, more preferably 0.3 μm to 8.0 μm. This is because if this thickness is too low, then there tends to be less shininess, whereas if this thickness is too high, then the impact resistance tends to drop. Moreover, the mean particle diameter of the glass pieces is preferably in a range of 5 μm to 250 μm, more preferably 40 μm to 150 μm. This is because if the mean particle diameter is too low, then it becomes difficult to realize shininess, whereas if the mean particle diameter is too high, then asperity will be seen on the surface of the coating film, and hence there will be a deterioration in the external appearance, and moreover the impact resistance will drop. Note that the mean particle diameter here is the value measured using the Microtrac method (laser diffraction type particle size distribution measurement method).

Moreover, the aspect ratio of the glass pieces (the mean particle diameter divided by the mean thickness) is preferably in a range of 10 to 40, more preferably 10 to 30, particularly preferably 15 to 20. This is because if the aspect ratio is too low, then the effects described above due to the glass pieces being made to be plate-shaped will be reduced, whereas if the aspect ratio is too high, then the strength of the coating film tends to drop. Moreover, the specific gravity of the glass pieces will be close to that of glass, specifically approximately 2.5 to 3, which is lower than that of a metal powder or metal foil. The dispersibility is thus good, and hence workability is good, and there is little deviation in color tone.

Examples of the metal oxide with which the glass pieces are coated include titanium oxide, zirconium dioxide, and iron oxide, with examples of the titanium oxide being anatase-type titanium dioxide and rutile-type titanium dioxide. Titanium oxide, in particular rutile-type titanium dioxide, is preferable, due to being excellent in terms of cost, and also excellent in terms of product quality, for example the color of interference light. Moreover, a metal oxide having a refractive index higher than that of the glass substrate that is coated by the metal oxide is preferable.

The thickness of the coating layer is preferably in a range of 0.01 μm to 1.0 μm. This is because the interference effect described earlier is hardly realized with a thickness outside this range. Moreover, by suitably changing the thickness of the coating layer within this range, the color of the interference light produced by the interference effect can be changed. For example, in the case of coating with titanium dioxide, the color of the interference light changes from silver to yellow to red to blue to green as the thickness of the coating layer is increased. It is thus easy to set the interference color, and moreover by using a mixture of glass pieces having different interference colors, a variety of colors can be obtained. Moreover, as the method of coating the glass substrate with the metal oxide, a liquid phase method, vapor deposition, or the like can be used.

To manufacture a golf club head according to the embodiment described above, a coating process such as the following is carried out. First, the surface of the head substrate 3 is polished using sandblasting, a wire brush, sandpaper, a barrel or the like, and then the primer layer 2*a* is applied on. In the case that the primer layer 2*a* is, for example, made of a thermosetting coating material, baking by heating as appropriate to carry out curing is then carried out, thus forming a cured coating film. The colored layer 2*b*, the shiny layer 2*c*, and the clear layer 2*d* are then similarly applied on in this order.

Here, it is not necessary to polish the surface of the head substrate 3 to a mirror finish or a satin finish to bring out the metallic luster, as conventionally carried out in the case of color clear coating to give shininess and an impression of the coating film being thick. This is because with the present invention, shininess is realized through the shiny layer 2*c*, and hence it is not necessary to bring out shininess through the luster of the surface of the head substrate 3. The coating can be carried out in a state in which the surface of the head substrate 3 is rough having been sandblasted or the like, and hence the adhesion of the coating film can be increased. From this viewpoint, with the present invention, as the surface treatment of the head substrate 3, it is preferable to carry out sandblasting, whereby a particularly uniform surface roughness can be attained through a simple method.

Moreover, regarding the surface roughness of the head substrate 3, the ten-point mean roughness (the ten-point mean roughness Rz as stipulated in Paragraph 5 of JIS B0601-1994) is preferably in a range of 1.0 μm to 100 μm, more preferably 5.0 μm to 60 μm, particularly preferably 10 μm to 50 μm. This is because if the ten-point mean roughness is too low, then the adhesion of the coating film may be poor, whereas if the ten-point mean roughness is too high, then asperity will become prone to appearing on the surface of the coating film, resulting in deterioration of the external appearance in some cases.

Figure 3:
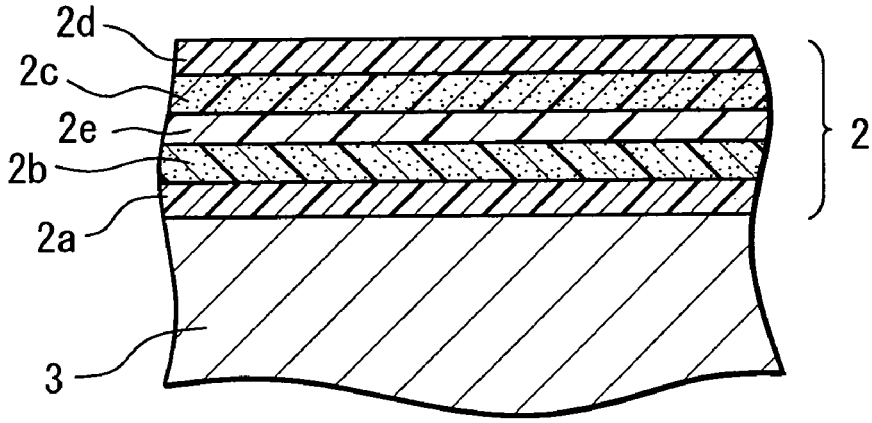
FIG. 3 is an enlarged sectional view of a coating film part of a golf club head according to another embodiment of the present invention.

In the present embodiment, the coating film 2 comprises a total of four layers, the primer layer 2*a*, the colored layer 2*b*, the shiny layer 2*c* and the clear layer 2*d*, but there is no limitation to this with the present invention. For example, as shown in FIG. 3, which shows an enlarged sectional view of the coating film, a polarizing layer 2*e* made of a polarizing coating material containing a polarizing pigment may be formed between the colored layer 2*b* and the shiny layer 2*c* of the present embodiment. In the case that the coating film 2 contains a colored layer 2*b* made of a color coating material containing a color pigment, a polarizing layer 2*e* formed on the outside of the colored layer 2*b*, and a shiny layer 2*c* formed on the outside of the polarizing layer 2*e* in this way, reflected light from the colored layer 2*b* and various types of light transmitted by the shiny layer 2*c* are both subjected to a polarizing effect by the polarizing layer 2*e*, and hence through this plurality of polarizing effects, reflected light having a variety of polarization and high shininess can be obtained. An external appearance having both high shininess and a luxurious impression can thus be produced.

As the polarizing pigment, a pearl pigment such as mica, metal flakes such as aluminum flakes, or the like can be used. The polarizing pigment may have a colored surface. The content of the polarizing pigment in the polarizing coating material is preferably in a range of 0.1 to 10 wt % relative to the solid component (vehicle component) of the polarizing coating material. If this content is too high, then the durability of the polarizing layer tends to drop, whereas if this content is too low, then it becomes difficult to realize the polarizing effects.

Furthermore, as another embodiment, it is possible to make the colored layer 2*b* contain the metal oxide-coated glass pieces. That is, a layer of a coating material containing both the color pigment and the glass pieces is provided. As a result, a colored shiny layer that serves as both the colored layer and the shiny layer is formed, and hence the structure of the coating film can, for example, be made to be 3-layer structure comprising a primer layer formed on the surface of the head substrate, the colored shiny layer formed on the primer layer, and a clear layer formed on the colored shiny layer. If a colored shiny layer is used in this way, then the optical transparency of the shiny layer is reduced by the color pigment, and hence the shininess effect is reduced, but there is an advantage that the coating process can be shortened.

Note that as the primer layer contacting the metal surface, an epoxy resin, which gives relatively good adhesion to metal, may be used. However, if, for example, a color clear layer is provided on the outside of the primer layer as carried out conventionally, then light will pass through the color clear layer and reach the epoxy resin primer layer. However, epoxy resins have poor light resistance, being particularly prone to being decomposed by ultraviolet radiation, and hence there has been a problem that upon being subjected to ultraviolet radiation outdoors, the epoxy resin layer is decomposed or altered, and hence the adhesion of the coating film drops. Furthermore, in this case, discoloration of the epoxy resin such as yellowing occurs due to the ultraviolet radiation, and hence there has been a problem that in the case that the color tone of the color clear layer is a bright color in particular, this discoloration is conspicuous. However, if, as in the present embodiment, a colored layer is provided on the primer layer, then the amount of ultraviolet radiation reaching the primer layer is greatly reduced, and hence the weather resistance of the coating film can be improved.

EXAMPLES

The present invention will now be described more concretely through examples and comparative examples. In the examples and comparative examples, Metashine MC1080RS made by Nippon Sheet Glass Co., Ltd. was used as the metal oxide-coated glass pieces. This is a glass substrate made of C glass coated with rutile-type titanium dioxide, and the mean thickness of the glass pieces is 1 μm, the mean particle diameter is 80 μm, the specific gravity is approximately 2.8, and the titanium dioxide coating thickness is approximately 0.05 μm. In each of the examples and comparative examples, the order of forming the various layers was made to be primer layer, colored layer, polarizing layer, shiny layer, metallic layer, clear layer from the bottom (the head substrate side), with which layers to provide being selected as appropriate in accordance with the form of the example or comparative example in question. The colored layer was made to be black. Moreover, for the primer layer, a polyester resin was used as the base resin, and for the other layers, an acrylic resin was used as the base resin. Furthermore, for the shiny layer, a coating material comprising the clear coating material containing the glass pieces therein was used. As the polarizing pigment for the polarizing layer 'Chroma Flair' (registered trademark), which is aluminum flakes, made by Flex Products Inc. was used. Regarding the coating process, the surface of the head substrate was sandblasted, and then degreasing was carried out, and then the various layers were coated on. Note that the 'metallic layer' is a coating film layer comprising a coating material containing a metal powder, which has been used from hitherto as a coating material having shininess. Also note that in all of the examples and comparative examples, the ten-point mean roughness of the head substrate was 20 μm.

Regarding the evaluation, the adhesion was evaluated in accordance with JIS-K5400. Moreover, for the impact resistance, a 500 g iron rod was dropped onto the coating film part of the head from a height of 150 mm, the state of peeling off of the coating film was observed visually, the size and depth of the damage were observed in an overall way, and evaluation was carried out at one of five levels (with a higher number implying better impact resistance).

For the evaluation of the external appearance, 20 golf players (10 top amateurs and 10 average golfers) visually evaluated the attractiveness (luxurious impression) of the external appearance, and a rating was determined according to the following criteria.

5: 17 to 20 of the golf players said that there was a luxurious impression.

4: 12 to 16 of the golf players said that there was a luxurious impression.

3: 7 to 11 of the golf players said that there was a luxurious impression.

2: 3 to 6 of the golf players said that there was a luxurious impression.

1: 0 to 2 of the golf players said that there was a luxurious impression.

For the evaluation of the shininess, 20 golf players (10 top amateurs and 10 average golfers) visually evaluated the shininess, and a rating was determined according to the following criteria.

5: 17 to 20 of the golf players said that there was shininess.

4: 12 to 16 of the golf players said that there was shininess.

3: 7 to 11 of the golf players said that there was shininess.

2: 3 to 6 of the golf players said that there was shininess.

1: 0 to 2 of the golf players said that there was shininess.

The results obtained are shown in Table 1 below.

TABLE 1

| | Examples | | | | Comparative Examples | | | |
|---|---|---|---|---|---|---|---|---|
| | 1 | 2 | 3 | 4 | 1 | 2 | 3 | 4 |
| Thickness of primer layer (μm) | 15 | 15 | 15 | 15 | 15 | 15 | 15 | 15 |
| Thickness of colored layer (μm) | 15 | 15 | 15 | 15 | 15 | 15 | 15 | 15 |
| Thickness of polarizing layer (μm) | — | 20 | — | — | — | — | 20 | — |
| Thickness of shiny layer (μm) | 20 | 20 | 20 | 20 | 20 | 20 | 40 | — |
| Thickness of metallic layer (μm) | — | — | — | — | — | — | — | 15 |
| Thickness of clear layer (μm) | 20 | 20 | 20 | 20 | 20 | 20 | 20 | 20 |
| Total thickness of coating film (μm) | 70 | 90 | 70 | 70 | 70 | 70 | 110 | 65 |
| Content of glass pieces (wt %) | 0.1 | 0.1 | 0.05 | 0.5 | 0.005 | 2.0 | 0.1 | — |
| Metal oxide coating thickness (μm) | 0.05 | 0.05 | 0.05 | 0.05 | 0.05 | 0.05 | 0.05 | — |
| Adhesion evaluation | 5 | 5 | 5 | 5 | 5 | 5 | 5 | 5 |
| Impact resistance evaluation | 5 | 4 | 5 | 5 | 5 | 4 | 2 | 5 |
| Shininess evaluation | 5 | 5 | 4 | 5 | 3 | 5 | 5 | 2 |
| External appearance evaluation | 5 | 5 | 4 | 5 | 3 | 2 | 5 | 1 |

Content of glass pieces in Table 1 is wt % relative to solid component of shiny coating material Referring to the evaluation results in Table 1, it can be seen that the adhesion is excellent for all of the examples, and that compared with the comparative examples, for the examples the evaluation is good with the rating being at least 4 for all of the impact resistance, the shininess and the external appearance. In contrast, for each of the comparative examples, the rating for at least one of the impact resistance, the shininess and the external appearance is 3 or lower. It can thus be seen that the examples are superior to the comparative examples. That is, with the examples, it was possible to achieve both excellent adhesion and a high level of shininess, luxurious impression, and impact resistance.

What is claimed is:

1. A golf club head having a coating film formed on a surface of a head substrate;

wherein said coating film contains a shiny layer made of a shiny coating material containing optically transparent metal oxide-coated glass pieces;

the content of said glass pieces in said shiny coating material is in a range of 0.01 wt% to 1.0 wt% relative to the solid component of said shiny coating material; and said coating film has a total thickness of not more than 100 μm, and wherein said coating film comprises in order a colored layer that is made of a color coating material containing a color pigment; a polarizing layer that is formed on said colored layer and comprises a polarizing coating material containing a polarizing pigment; and said shiny layer formed on said polarizing layer.

2. The golf club head according to claim 1, wherein a clear layer that is made of a clear coating material is provided on the outside of said shiny layer, and said clear layer is the outermost layer of said coating film.

3. The golf club head according to claim 1, wherein said shiny coating material comprises a clear coating material having said glass pieces contained therein.

4. The golf club head according to claim 1, wherein said glass pieces have a mean thickness in a range of 0.1 μm to 10 μm, and a mean particle diameter in a range of 5 μm to 250 μm.

5. A golf club head having a coating film formed on a surface of a head substrate;

wherein said coating film contains a shiny layer made of a shiny coating material containing metal oxide-coated glass pieces;

the content of said glass pieces in said shiny coating material is in a range of 0.05 wt% to 0.5 wt% relative to the solid component of said shiny coating material; and said coating film has a total thickness of not more than 100 μm, and wherein said coating film comprises in order a colored layer that is made of a color coating material containing a color pigment; a polarizing layer that is formed on said colored layer and comprising a polarizing coating material containing a polarizing pigment; and said shiny layer formed on said polarizing layer.

6. The golf club head according to claim 5, wherein a clear layer that is made of a clear coating material is provided on the outside of said shiny layer, and said clear layer is the outermost layer of said coating film.

7. The golf club head according to claim 5, wherein said shiny coating material comprises a clear coating material having said glass pieces contained therein.

8. The golf club head according to claim 5, wherein said glass pieces have a mean thickness in a range of 0.1 μm to 10 μm, and a mean particle diameter in a range of 5 μm to 250 μm.

* * * * *